US006776638B2

(12) United States Patent
Thurston

(10) Patent No.: US 6,776,638 B2
(45) Date of Patent: Aug. 17, 2004

(54) BREAKAWAY LOCKING CONNECTOR

(75) Inventor: Bryan A. Thurston, Johnston, RI (US)

(73) Assignee: Alden Products Company, Brockton, MA (US)

( * ) Notice: Subject to any disclaimer, the term of this patent is extended or adjusted under 35 U.S.C. 154(b) by 0 days.

(21) Appl. No.: 10/202,514

(22) Filed: Jul. 23, 2002

(65) Prior Publication Data

US 2004/0018764 A1 Jan. 29, 2004

(51) Int. Cl.[7] ..... H01R 13/62
(52) U.S. Cl. ..... 439/312; 439/923
(58) Field of Search ..... 439/312–319, 439/923

(56) References Cited

U.S. PATENT DOCUMENTS

| | | | | | |
|---|---|---|---|---|---|
| 3,719,918 | A | * | 3/1973 | Kerr | 439/319 |
| 4,070,080 | A | * | 1/1978 | Eshleman et al. | 439/345 |
| 4,142,769 | A | | 3/1979 | Wood | 339/88 R |
| 4,146,288 | A | * | 3/1979 | Ramsay et al. | 439/316 |
| 4,148,542 | A | | 4/1979 | Wood | 339/126 RS |
| 4,154,498 | A | | 5/1979 | Wood et al. | 339/128 |
| 4,235,832 | A | | 11/1980 | Leighton | 264/230 |
| 4,239,315 | A | * | 12/1980 | Lacaze, Jr. | 439/312 |
| 4,243,291 | A | | 1/1981 | Leighton | 339/184 M |
| 4,339,407 | A | | 7/1982 | Leighton | 264/229 |
| 4,359,255 | A | * | 11/1982 | Gallusser et al. | 439/316 |
| 4,481,380 | A | | 11/1984 | Wood et al. | 174/52 PE |
| 4,568,139 | A | | 2/1986 | Wood | 339/255 R |
| 4,568,795 | A | | 2/1986 | Wood | 174/52 PE |
| 4,582,388 | A | | 4/1986 | Swaffield | 339/258 TC |
| 4,588,245 | A | * | 5/1986 | Schwartz et al. | 439/312 |
| 4,684,189 | A | | 8/1987 | Swaffield | 439/587 |
| 4,720,764 | A | | 1/1988 | Lucas | 361/212 |
| 4,773,871 | A | | 9/1988 | Behning | 439/181 |
| 4,820,185 | A | * | 4/1989 | Moulin | 439/321 |
| 5,067,909 | A | | 11/1991 | Behning | 439/315 |
| 5,167,522 | A | | 12/1992 | Behning | 439/315 |
| 5,211,587 | A | | 5/1993 | Alden | 439/843 |
| 5,662,488 | A | | 9/1997 | Alden | 439/314 |
| 5,707,252 | A | | 1/1998 | Meszaros | 439/610 |
| 5,816,835 | A | | 10/1998 | Meszaros | 439/205 |
| 6,010,348 | A | | 1/2000 | Alden | 439/274 |
| 6,226,068 | B1 | | 5/2001 | Arcykiewicz et al. | 349/314 |

* cited by examiner

*Primary Examiner*—P. Austin Bradley
*Assistant Examiner*—X. Chung-Trans
(74) *Attorney, Agent, or Firm*—Lahive & Cockfield, LLP; Thomas V. Smurzynski

(57) ABSTRACT

A breakaway locking connector system includes a first body having a rotatable collar mounted thereon and a second body configured to mate with the first body and automatically disengage from the first body when a predetermined force is applied to the connector system. The first and second bodies include telescopingly engaged body portions and axially mating contacts. The connector system further includes an annular collar encircling the telescoping body portions and rotatively held on the first body and a spring inside the collar. The ends of the spring are confined between the first body and the collar so as yieldingly to resist rotation of the collar relative to the first body. Axially aligned tabs are provided on the collar and the second body for latching the first body and the second body together through a predetermined range of forces. The tabs include opposed flaring cam surfaces, which cause the collar to rotate relative to the second body as the first and second body are telescoped to a mated contact position and at least one tab includes an angled back surface. The cam surfaces guide the collar tab around the body tab, and the coiled spring yields as the collar is rotated by the cam tabs during contact mating to allow the collar tab to slide past the body tab. The spring then rotates the collar tab to a latching position axially behind the body tab, thereby locking the connector bodies in mated contact position. When a predetermined pulling force is applied to the mated bodies, the body tab and the collar tab are configured to automatically disengage without damaging the components of the connector.

19 Claims, 2 Drawing Sheets

BREAKAWAY LOCKING CONNECTOR

FIELD OF THE INVENTION

The present invention relates to an automatically locking connector system for joining a first connector body with a second connector body. More particularly, the present invention relates to an automatically locking connector system that automatically disengages at a predetermined force.

BACKGROUND OF THE INVENTION

Automatically locking connector systems are used for a variety of applications, such as electrical, fluidic, mechanical, optical, hydraulic or pneumatic systems, to provide a connection between various components and devices. A typical connector may comprise a female connector assembly and a male connector assembly that are designed to be engaged and disengaged with one another. Prior patents describe a coupling mechanism, having one coupler half that is inserted into the other half and a sleeve on one half, which rotates against a torsional spring force as a result of the camming action of complementary triangularly-shaped tabs on the sleeve and the inserted coupler half. The restoring force of the spring causes the sleeve to rotate into a locking position after the complementary tabs have passed each other. The tabs prevent disengagement of the coupler halves until the sleeve is twisted to permit the tabs to clear each other during uncoupling. For example, U.S. Pat. Nos. 5,067,909, 5,167,522 and 5,662,488, all of which are incorporated herein by reference, describe automatically locking couplers, in which a locking sleeve is rotated against a spring force during initial insertion of one coupler half into the other, and permitted to rotate back into a locking position upon completion of insertion.

With telescopically mating electrical connectors, such as a plug and a socket, it is often desirable or necessary to lock the two connector bodies together after their conductive contacts have been physically and electrically joined. Single conductor connectors with some form of bayonet joint may be rotated to a locking position. Multiple male and female contacts, however, must be slidingly joined telescopically without rotation, and typically have used a pliable plastic connector body which is deformed as a catch on one connector body rides over a detent on the other connector body to a locking position beyond the detent. If such a deforming latching body is frequently engaged and disengaged, the plastic tends to fatigue from the deformation. As a result, the latching mechanism eventually fails. In addition, care must be taken during assembly of the connector to ensure that the connectors fully engage with each other.

Most locking connectors are designed to lock in the mated position and must be manually disengaged. In certain applications, it is desirable that the connectors automatically disconnect when a force exceeding a predetermined level is applied to the connector assembly or a cable extending from the connector assembly. For example, requirements exist in some industries that a mated pair of connectors disengage (or break away) before the cable is damaged, the connector pair is damaged, personnel trip over the cord, electrodes connected to the connector are stripped off a patient (in medical applications) and/or attached equipment, such as an electronic device, falls and becomes damaged, falls from a shelf and crashes to the floor or falls in such a way to cause personal injury.

SUMMARY OF THE INVENTION

The present invention provides a breakaway locking connector configured to disengage at a predetermined force.

The present invention combines a self-latching arrangement with an automatic de-coupling arrangement in a connector system. The breakaway locking connector comprises first and second tubular connector bodies having telescopingly engaged body portions and axially mating contacts, an annular collar rotatively held on the first body encircling the telescoping body portions and a spring inside the collar. The ends of the spring are confined between the first body and the collar so as to yieldingly resist rotation of the collar relative to the first body. Axially aligned tabs are provided on the collar and the second body for latching the first body and the second body together through a predetermined range of forces. The tabs include opposed flaring cam surfaces, which cause the collar to rotate relative to the second body as the first and second body are telescoped to a mated contact position. The cam surfaces guide the collar tab around the body tab, and the coiled spring yields as the collar is rotated by the cam tabs during contact mating to allow the collar tab to slide past the body tab. The spring then rotates the collar tab to a latching position axially behind the body tab, thereby locking the connector bodies in mated contact position. When a predetermined breakaway force is applied to the mated bodies, the body tab and the collar tab are configured to automatically disengage without damaging the components of the connector.

BRIEF DESCRIPTION OF THE FIGURES

FIGS. 8*a* and 8*b* illustrate the second connector body according to an alternate embodiment of the invention.

DETAILED DESCRIPTION OF THE INVENTION

The present invention provides a self-latching connector system that automatically disengages at a predetermined breakaway force to prevent damage to the connector system, equipment attached to the connector system and/or personal injury. The invention will be described below relative to illustrative embodiments. Those skilled in the art will appreciate that the present invention may be implemented in a number of different applications and embodiments and is not specifically limited in its application to the particular embodiments depicted herein.

Figure 1:
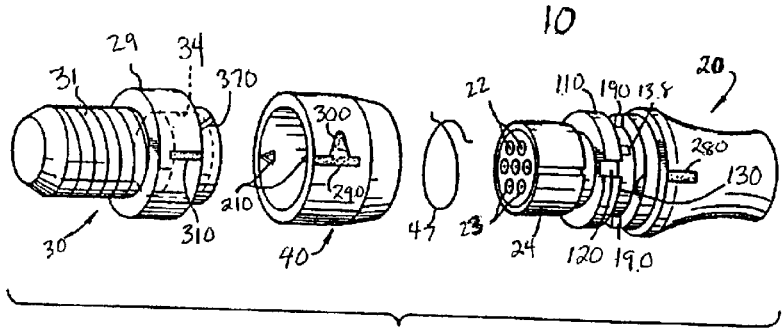
FIG. 1 is an exploded isometric view of a connector system according to an illustrative embodiment of the invention with first and second connector bodies and a collar.
Figure 2:
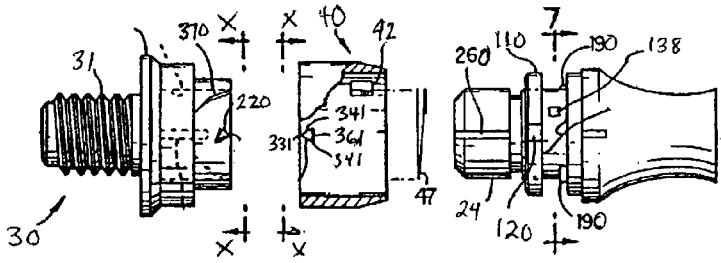
FIG. 2 is an exploded side view, of the first body, collar and second body of the connector system according to an illustrative embodiment of the invention.
Figure 4:
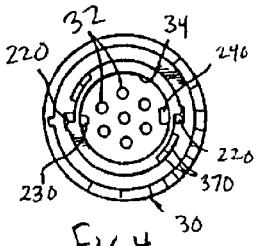
FIG. 4 is an end elevation view of the first body viewed from a plane X—X between the collar and second body.

FIG. 1 illustrates a breakaway locking connector 10 according to an illustrative embodiment of the invention. According to the illustrative embodiment, the connector 10 is used in an electrical application, though one skilled in the art will recognize that the connector can be implemented in any suitable system. The connector 10 comprises a first connector body or plug 20 and a second connector body or receptacle 30 configured to receive and/or engage the first connector body 20. According to the illustrative embodiment the first connector body 20 is a male connector having a cylindrical shaped housing with male contacts 22 enclosed in recesses 23 of an insulative boss 24. The illustrative second connector body 30 is a female connector having a cylindrical shaped housing defining a cavity 34 for receiving the boss 26. The second body further includes female contacts 32 disposed in the cavity 34 for mating with the male contacts 22 of the first connector 20. The plug boss 24 telescopes into the cavity 34 of the second connector body or receptacle 30, such that the male contacts 22 axially mate with the female contacts 32 when the first body 20 engages the second body 30 along the longitudinal axis A—A. The second body may further include a flange 29 and threads 31 for mounting the second body in a panel with a nut or other suitable mating device.

An annular collar 40 is rotatably mounted on the first connector body 10 to latch the connector bodies 20, 30 together. When the two bodies are mated, the annular collar 40 encircles the boss 24 of the first body and the socket 34 of the second body to hold the connector bodies together. According to the illustrative embodiment, the collar 40 includes one or more internal radial stops 42 and the first connector body includes a first flange 110 having one or more passageways 120 extending longitudinally and configured to receive the stops 42 on the collar 40. An annular groove 130 is also formed on the first connector body 20 for receiving the internal radial stops 42 of the collar.

The collar 40 is mounted to the first body 20 by sliding the collar 40 along the longitudinal axis A—A over the boss 24, such that the internal radial stops 42 on the collar 40 are admitted through the passageways 120 on the first body and into the annular groove 130. The annular groove 130 axially confines the stops and holds the collar 40 rotatively around the first body 10. The stops limit the amount of rotation of the collar to a range of about forty degrees. One skilled in the art will recognize that other suitable means of rotatably locking the annular collar 40 to the first connector body 20 may be used in accordance with the teachings of the invention.

The collar further includes at least one camming tab 210 configured to engage one or more camming tabs 220 on the second body to lock the connector bodies together. According to the illustrative embodiment, the camming tabs 210, 220 comprise opposing, pie-shaped protrusions, though other configurations may be used according to the present invention. The camming tabs 210, 220 comprise opposing points 331, 332, respectively, and two camming surfaces 341, 342, respectively, flaring away from each point to intersection with a back surface 361, 362, respectively.

Figure 3:
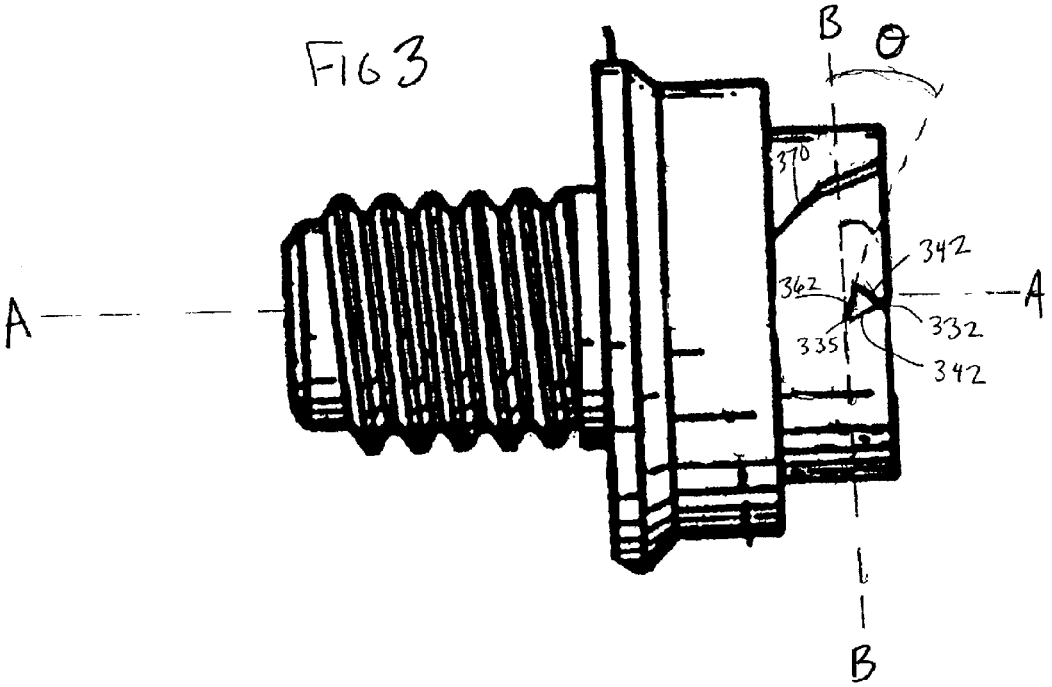
FIG. 3 is an enlarged view of the second body, illustrating in detail the configuration of the camming tab.
Figure 3:
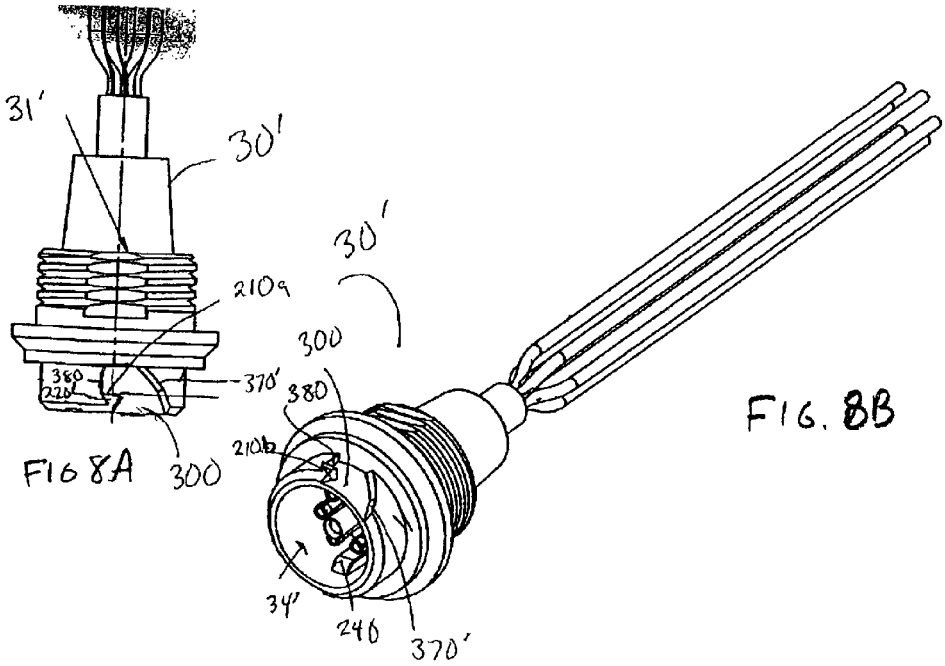

According to the illustrative embodiment, one or more of the back surfaces 361, 362, preferably the back surface 362 on the second connector 30, is angled relative to a radial axis B—B that extends along the direction of rotation of the collar and perpendicular to the longitudinal axis A—A, as shown in detail in FIG. 3 to facilitate automatic release of the connector bodies when a predetermined force is applied to the connector system. The angled back surface 362 of the receptacle tab contrasts the camming tabs described in U.S. Pat. Nos. 5,067,909, 5,167,522 and 5,662,488, which extend in the direction of rotation of the collar, perpendicular to the longitudinal axis A—A. As shown, the back surface 362 is inclined from the radial direction to form a ramp that extends axially and radially forward from a back point 335 of the camming tab 220. As used herein, "radially" refers to the direction of rotation of the collar and "axially" refers to the direction of the axis A—A, i.e. along the longitudinal axis of the connector system. "Radially forward" refers to the direction of rotation of the collar indicated by the marker 300 on the collar and "axially forward" refers to the direction of movement of the first body relative to the second body during disengagement. According to the illustrative embodiment, the back surface of the receptacle camming tab extends at an angle θ, which is between about 5 degrees and about 45 degrees relative to the line B—B, as shown in FIG. 3, and relative to the back surface of the camming tabs described in U.S. Pat. No. 5,067,909. The operation of the camming tabs will be described in detail below.

Figure 5:
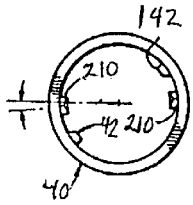
FIG. 5 is an end elevation view of the collar viewed from a plane X—X between the collar and second body.
Figure 6:
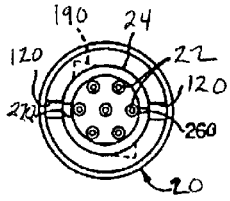
FIG. 6 is an end elevation view of the second body viewed from a plane X—X between the collar and second body.
Figure 7:
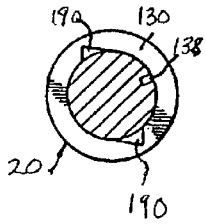
FIG. 7 illustrates a section on line 7—7 of FIG. 2 of the connector system.

A coiled spring 47 may be provided for biasing the collar 40 into a normal position when the collar is mounted on the first connector body 20. The coiled spring 47, illustrated as a round wire of spring metal, though any suitable mechanism for biasing the collar may be used, is also confined in the annular groove 130 of the first body 20. The spring 47 may be anchored at a first end inside the collar at a first stop 142 (shown in FIG. 5) and at a second end in a small recess 138 in the groove 130. As shown in FIG. 6, the spring 47 is biased yieldingly to constantly urge the collar stops 42 to a normal position abutting the opposed stops 190 in the groove 130. In the rest position, as described in detail below, the camming tabs 210 provided on the collar 40 are located relative to the male contacts 22 of the first body such that the collar camming tabs 210 and male contacts 22 are in matching alignment with corresponding camming tabs 220 on the second body 20 and the female contacts 32 on the second body 20, respectively.

The insulative boss 24 of the first connector body 10 further includes longitudinal keyways 260 and 270, which receive keys 230 and 240 formed on an inner surface of the receptacle cavity on the corresponding female connector to assure correct angular alignment during mating engagement. The keys may comprise a relatively narrow key 230 and a relatively wide key 240 and the keyways may comprise a relatively narrow keyway 260 for receiving the narrow key 230 and a relatively wide keyway 270 for receiving the wide key 240. The keys and keyways are arranged such that when the first connector body 20 and the second connector body 30 are engaged (i.e. the keys are inserted in the corresponding keyways), the collar camming tabs 210 have substantially the same angular relationship to the male contacts as the receptacle camming tabs have to the female contacts when the collar is in the rest position.

Index marks may also be provided as a visual aid to the correct angular alignment in alignment of the bodies 20, 30. For example, the illustrative connector system includes a first index mark 290 on the collar, a second index mark 280 on the first body and a third index mark 310 on the second body, which align when the connector bodies are properly engaged. The mark 290 on the collar may further include an arrowhead 300 indicating the direction in which the collar 40 can be rotated from the normal position during the two operations of locking engagement and disengagement of the two bodies.

To lock the male and female connector together, the markers 290, 310 on the collar 40 and the female connector 30, respectively, are manually aligned and the two bodies are pushed together along the longitudinal axis A—A to achieve a snap-lock. When the bodies are pushed together, the second body 30 receives the first body 10, as the boss 24 telescopes in the cavity 34 and the keys 230, 240 slide into the keyways 260, 270, respectively. At the same time, the camming tabs 210, 220 slide past each other. The collar camming tab 210 is offset a small angle from a central plane through the collar and receptacle to facilitate engagement. After first sliding engagement, the mutual edging action of the camming surfaces 341, 342 forces the collar 40 to rotate against the spring, allowing the collar tab 210 to slide around the receptacle tab 220 and then spring back with its back surface 361 behind the back surface 362 of the receptacle tab 220.

In this position, the tabs lock the first body 20 to the second body 30 through a predetermined range of forces. The spring 47 reverses rotation of the collar 40 until the faces of the collar stops strike the opposed faces of the plug stops. An audible "snap" signals that the first body 20, the plug, and the second body 30, the receptacle, are locked together. Locking may be visually confirmed by alignment of the index marks after the automatic return of the collar to its normal position by the spring. The camming tabs 210, 220 are configured to provide automatic release when a predetermined force is applied to one or both of the bodies.

The connectors may be released manually, by rotating the collar 40, or by applying a predetermined breakaway force to the connectors along the longitudinal axis A—A. To disengage the connectors, the collar 40 is manually rotated in the direction of the arrowhead 300. The rotation of the collar 40 turns the collar camming tabs 210 towards a circumferential ramp 370 slanting across the paths of the tabs. The camming face of each ramp is angled away from the adjacent tab, so that it cams the collar tab 210, collar 40 and first body 20 apart and out of engagement with the second body 30. In this manner, disengagement can be effected without pulling and straining the cord extending from the plug, because the rotation of the collar is in a plane at right angles to the axis of the plug and cord.

The camming tabs are also configured to automatically disengage upon application of a predetermined breakaway force to either of the connector bodies. For example, as shown, the back surface 362 of the receptacle camming tab is angled relative to the direction of rotation of the collar 40 to provide automatic release upon application of a force along the longitudinal axis A—A that exceeds a predetermined value. The predetermined breakaway force is inversely proportional to the angle of the back surface of the receptacle camming tab relative to the line B—B. According to the illustrative embodiment, the back surface 362 of the receptacle camming tab 220 is angled about 10 degrees, as shown in FIG. 3, to enable automatic disengagement of the connector upon application of a force that exceeds the predetermined breakaway force. According to the illustrative embodiment, the predetermined breakaway force is between about one pound and about twenty pounds and preferably about ten pounds. When a pulling force larger than about the predetermined breakaway force is applied, the sloping back surface allows the collar camming tab 210 to slide past the receptacle camming tab 220, releasing the connection without damaging the connector components and/or before damage to equipment or persons occurs. In contrast, the camming tabs described in the prior art have back surfaces which are substantially perpendicular to the longitudinal direction along axis A—A, which prevent the tabs from sliding past each other when a pulling force is applied along the longitudinal axis.

According to an alternate embodiment, a receptacle body 30' of the locking connector pair includes engagement recesses 300 formed in the exterior of a cavity 34', as shown in FIGS. 8*a* and 8*b*, in place of the camming tab and circumferential ramp. The engagement recesses 300 are configured to engage with the collar camming tabs 210 to temporarily lock the collar to the second body. Each engagement recess 300 includes a ramped wall 370' corresponding to the circumferential ramp 370 of the receptacle 30 of FIGS. 1–9, a longitudinal wall 380 and a protrusion 220' forming a camming tab extending from the longitudinal wall 380. As shown, the protrusion includes a back wall 220*a* extending axially and radially forward from the longitudinal wall 380 at a predetermined angle relative to the line B—B and a camming wall 220*b* forming a camming surface for allowing the collar tab to slide past the protrusion 220' when slid along the longitudinal axis. The longitudinal wall 380 and the protrusion form a recess slot located axially behind the protrusion 220' for retaining the collar camming tab when the receptacle body 30' is engaged with the first plug body 20. As described above, the back wall 210*a* is angled by a selected amount to provide automatic release of the collar camming tab when a predetermined force is applied to the connector bodies.

One skilled in the art will recognize that the correlation between the angle of the back wall and the breakaway force depends on the type of material and properties of the material used to form the connector bodies. For example, for materials having a higher coefficient of friction, a relatively larger angle may correspond to a selected breakaway force, while materials having a lower coefficient of friction require a relatively smaller angle to obtain the selected breakaway force. According to the illustrative embodiment, the angle of the back wall of the receptacle camming tab is between about 5 and about 45 degrees relative to the radial axis B—B and the predetermined breakaway force is between about one and about twenty pounds, though one skilled in the art will recognize any suitable angle and breakaway force may be used in accordance with the present invention. One of ordinary skill in the art will be able to determine a suitable angle to provide a desired breakaway force in a connector system of the invention.

According to an alternate embodiment, the collar camming tabs may be angled to provide automatic de-coupling upon application of a predetermined force.

Furthermore, one skilled in the art will recognize that alternatively the collar may alternatively be mounted on the female connector and camming tabs may be provided on the male connector.

One skilled in the art will recognize that the invention is not limited to the illustrative automatic release mechanism and that other means of providing an automatic release mechanism may be used according to the teachings of the invention.

The rotating collar and camming tabs of the connector provide automatic locking engagement of the plug and socket without deformation of the plastic, insulative connector bodies or collar. Engagement is indicated positively by an audible snap and by alignment of index marks. The spring allows a rotary disengaging manipulation, which is convenient and which places no longitudinal strain on a cord or cable connected to the plug body. The connectors provide a secure connection up until a predetermined breakaway force and further allow automatic de-coupling of the connector system to prevent injury, damage to the connector bodies, damage to the cords attached to the connector bodies and/or damage to components attached to the connector bodies. The connector pair can be reused even after the bodies have been separated by the application of the predetermined force. The breakaway force can be modified by changing the angle of the back wall of the receptacle camming tab. Moreover, a receptacle body having a modified camming tab to allow for the automatic de-coupling can be used with current plug bodies, such as the male connector of the PULSE-LOK from Alden Products, described in U.S. Pat. No. 5,067,909 without requiring modification of the plug body. In this manner, a connector system can be easily converted to provide automatic de-coupling at a predetermined without requiring replacement of all of the components of the system.

The present invention has been described relative to an illustrative embodiment. Since certain changes may be made in the above constructions without departing from the scope of the invention, it is intended that all matter contained in the above description or shown in the accompanying drawings be interpreted as illustrative and not in a limiting sense. It should be understood that the present disclosure is for the purpose of illustration only, and that the invention includes all modifications and equivalents falling within the appended claims It is also to be understood that the following claims are to cover all generic and specific features of the invention described herein, and all statements of the scope of the invention which, as a matter of language, might be said to fall therebetween.

Having described the invention, what is claimed as new and protected by Letters Patent is:

1. A connector system comprising:

a first tubular connector body comprising a housing having a first body portion and first contact portions;

a second tubular connector body comprising a housing having a second body portion configured to telescopingly engage with the first body portion and second contact portions configured to axially mate with the first contact portions;

an annular collar rotatively held on the first body, wherein the annular collar encircles the first and second body portions when the first and second body portions are engaged;

a spring disposed inside the collar, the ends of the spring being confined between the first body and the collar so as yieldingly to resist rotation of the collar relatively to the first body;

at least one triangular-shaped collar tab on the collar; and at least one triangular-shaped receptacle tab on the second body axially opposed to said at least one collar tab for coupling the collar and first body to the second body, wherein the collar tab and the receptacle tab have opposing points from which cam surfaces flare in opposite directions and a back surface remote from the points and intersecting the cam surfaces, wherein opposed cam surfaces of the collar tab and receptacle tab cooperatively produce rotation of the collar relative to the second body as the first and second bodies are telescoped to a mated contact position, the cam surfaces guiding the collar tab around the body tab, wherein the coiled spring yields as the collar is rotated by the collar tab and receptacle tab during contact mating, and the spring then rotating the collar tab to a latching position axially behind the receptacle tab thereby locking the connector bodies in mated contacting position, wherein the back surface of the receptacle tab inclined at an angle relative to the direction of rotation of the collar to allow the receptacle tab to release the collar tab when a predetermined breakaway force is applied to one of said first connector body and said second connector body along a longitudinal axis of the connector system.

2. The connector system of claim 1, wherein the predetermined breakaway force is less than about 20 pounds.

3. The connector system of claim 1, wherein the predetermined breakaway force is less than about 10 pounds.

4. The connector system of claim 1, wherein the angle is less than about 45 degrees relative to the direction of rotation of the collar.

5. The connector system of claim 1, wherein the angle is between about 5 degrees and about 20 degrees relative to the direction of rotation of the collar.

6. The connector system of claim 1, wherein the angle is about 10 degrees relative to the direction of rotation of the collar.

7. The connector system of claim 1, wherein the collar and first body have rotationally opposed stops mutually engaging to limit rotation of the collar by the spring relative to the first body.

8. The connector system of claim 7, wherein the stops are disposed normally to position the collar relative to the first body with the collar tab located with respect to the electrical contacts on the first body in a matching alignment for mating with the contacts and receptacle tab of the second body.

9. The connector system of claim 8, wherein the spring urges the collar stops to a normal position striking the stops on the first body.

10. The connector system of claim 9, wherein the stops have opposed faces producing an audible snap when urged by the spring to an engaged position.

11. The connector system of claim 8, wherein one of said first body and second body has a key and one of said first body and second body has a key way, said key and key way slidingly interfitting when the first and second bodies and the collar are in matching alignment.

12. The connector system of claim 1, wherein the second body has a circumferential ramp at the same radius as the collar tab, the ramp slanting across the path of the collar tab to cam the collar tab, collar and first body apart and out of engagement with the second body when the collar is manually rotated relative to the mated bodies.

13. The connector system of claim 1, wherein the spring returns the collar to matching alignment when the bodies are disengaged.

14. The connector system of claim 1, wherein the collar and second body have longitudinally matching index marks indicating matching alignment of the first and second body and collar.

15. The connector system of claim 1, wherein the first contact portions on the first body are male contacts and the second contact portions on the second body are female contacts for receiving the male contacts.

16. The connector system of claim 1, wherein the spring comprises a round wire of spring metal coiled around the first body.

17. The connector system of claim 1, wherein the second body includes at least one engagement recess formed in an outer surface for receiving the collar tab, said engagement recess comprising a circumferential ramp, a longitudinal wall and the receptacle tab protruding from the longitudinal wall, wherein the receptacle tab is formed by the opposed cam surface and an inclined back wall extending from the longitudinal wall at an angle greater than 90 degrees.

18. A connector system comprising:

a first tubular connector body comprising a housing having a first body portion and first contact portions;

a second tubular connector body comprising a housing having a second body portion configured to telescopingly engage with the first body portion and second contact portions configured to axially mate with the first contact portions;

an annular collar rotatively held on the first body, wherein the annular collar encircles the first and second body portions when the first and second body portions are engaged;

a spring disposed inside the collar, the ends of the spring being confined between the first body and the collar so as yieldingly to resist rotation of the collar relatively to the first body;

at least one collar tab on the collar, wherein the collar tab forms a first point and a first cam surface flaring from the first point; and at least one receptacle tab on the second body axially opposed to the at least one collar tab for coupling the collar and first body to the second body, wherein the receptacle tab forms a second point opposing said first point, a second cam surfaces flaring from the second point and an inclined back surface remote from the second point and extending from the second cam surface at an angle of between about 5 degrees and about 45 degrees relative to the direction of rotation of the collar, the first cam surface and the second cam surface cooperatively producing rotation of the collar relative to the second body as the first and second bodies are telescoped to a mated contact position, wherein the coiled spring yields as the collar is rotated by the collar tab and receptacle tab during contact mating, and the spring then rotating the collar tab to a latching position axially behind the receptacle tab thereby releasably locking the connector bodies in mated contacting position.

19. A connector system comprising:

a first tubular connector body comprising a housing having a first body portion and first contact portions;

a second tubular connector body comprising a housing having a second body portion configured to telescopingly engage with the first body portion and second contact portions configured to axially mate with the first contact portions;

an annular collar rotatively held on the first body, wherein the annular collar encircles the first and second body portions when the first and second body portions are engaged;

a spring disposed inside the collar, the ends of the spring being confined between the first body and the collar so as yieldingly to resist rotation of the collar relatively to the first body;

at least one collar tab on the collar having a camming surface; and at least one engagement recess formed on the second body for receiving the collar tab, comprising a circumferential ramped wall, a longitudinal wall and a protrusion extending from the longitudinal wall comprising an angled back wall extending radially and axially forward from the longitudinal wall at an angle and a camming wall intersecting the back wall and opposed to the camming surface of the collar tab, wherein the collar tab and the protrusion camming surfaces cooperatively produce rotation of the collar relative to the second body as the first and second bodies are telescoped to a mated contact position, the cam surfaces guiding the collar tab around the protrusion, wherein the coiled spring yields as the collar is rotated by the collar tab and protrusion during contact mating, and the spring then rotating the collar tab to a latching position axially behind the protrusion and into contact with the longitudinal wall thereby releasably locking the connector bodies in mated contacting position, wherein the back wall of the protrusion is angled to allow the receptacle tab to release the collar tab upon application of a predetermined force to one of said first body and said second body.

* * * * *